US011616325B2

(12) United States Patent
Xiao et al.

(10) Patent No.: US 11,616,325 B2
(45) Date of Patent: Mar. 28, 2023

(54) LOW INTERMODULATION RADIOFREQUENCY COAXIAL CONNECTOR

(71) Applicant: RESEARCH ON ELECTRICAL APPLIANCES OF SHANGHAI ASTRONAUTICS, Shanghai (CN)

(72) Inventors: Shunqun Xiao, Shanghai (CN); Xiujuan Kuang, Shanghai (CN)

(73) Assignee: RESEARCH ON ELECTRICAL APPLIANCES OF SHANGHAI ASTRONAUTICS, Shanghai (CN)

( * ) Notice: Subject to any disclaimer, the term of this patent is extended or adjusted under 35 U.S.C. 154(b) by 80 days.

(21) Appl. No.: 17/260,851

(22) PCT Filed: Nov. 22, 2018

(86) PCT No.: PCT/CN2018/116827
§ 371 (c)(1),
(2) Date: Jan. 15, 2021

(87) PCT Pub. No.: WO2019/223272
PCT Pub. Date: Nov. 28, 2019

(65) Prior Publication Data

US 2021/0265780 A1 Aug. 26, 2021

(30) Foreign Application Priority Data

May 24, 2018 (CN) ..... 201810506613.0

(51) Int. Cl.
*H01R 13/631* (2006.01)
*H01R 13/516* (2006.01)
(Continued)

(52) U.S. Cl.
CPC ..... *H01R 13/6315* (2013.01); *H01R 13/516* (2013.01); *H01R 24/40* (2013.01); *H01R 9/0527* (2013.01)

(58) Field of Classification Search
CPC .... H01R 24/40; H01R 9/0527; H01R 13/516; H01R 13/6315
See application file for complete search history.

(56) References Cited

U.S. PATENT DOCUMENTS 6,824,415 B2 11/2004 Wlos
7,351,088 B1 * 4/2008 Qu ..... H01R 24/40 439/352

(Continued)

FOREIGN PATENT DOCUMENTS

CN 1960082 A 5/2007
CN 104577400 A 4/2015

(Continued)

OTHER PUBLICATIONS

Chinese Office Action dated Apr. 19, 2019 issued in Patent Application No. 201810506613.0 (4 pages).

(Continued)

*Primary Examiner* — Briggitte R. Hammond
(74) *Attorney, Agent, or Firm* — Polsinelli PC

(57) ABSTRACT

A low intermodulation radiofrequency coaxial connector includes a first outer conductor and a second outer conductor matching the first outer conductor; a contact ring is provided between the first outer conductor and the second outer conductor, and the first outer conductor is elastically in contact with the second outer conductor through the contact ring. The radiofrequency coaxial connector can effectively suppress a nonlinear effect when radiofrequency signals are interconnected and ensure critical performance indicators such as low intermodulation for a radiofrequency interconnection. The low intermodulation contact ring in the radiof- (Continued)

requency coaxial connector is formed by connecting a head portion to a tail portion of a flexible metal material when punch molded, and has a simple structure, a reliable connection, a good workmanship, is easy to assemble, and is inexpensive.

9 Claims, 3 Drawing Sheets

(51) Int. Cl.
*H01R 24/40* (2011.01)
*H01R 9/05* (2006.01)

(56) References Cited

U.S. PATENT DOCUMENTS

| | | | |
|---|---|---|---|
| 9,912,110 | B2 | 3/2018 | Edmonds |
| 2012/0094530 | A1 | 4/2012 | Montena |
| 2018/0034213 | A1 | 2/2018 | Lutz et al. |

FOREIGN PATENT DOCUMENTS

| | | | |
|---|---|---|---|
| CN | 204424523 | U | 6/2015 |
| CN | 204538285 | U | 8/2015 |
| CN | 108631088 | A | 10/2018 |
| CN | 208284680 | U | 12/2018 |
| DE | 38 13 073 | C1 | 7/1989 |

OTHER PUBLICATIONS

Chinese Office Action dated Dec. 17, 2019 issued in Patent Application No. 201810506613.0 (4 pages).
Chinese Office Action dated Jul. 6, 2020 issued in Patent Application No. 201810506613.0 (4 pages).
International Search Report dated Feb. 26, 2019 issued in PCT/CN2018/116827 (4 pages).
European Search Report dated Feb. 9, 2022 issued in corresponding Patent Application No. 18919850.0 (8 pages).

* cited by examiner

LOW INTERMODULATION RADIOFREQUENCY COAXIAL CONNECTOR

CROSS REFERENCE TO RELATED APPLICATION

The present application is a National Stage of International Application PCT/CN2018/116827, filed Nov. 22, 2018, which claims priority to Chinese Patent Application No. 201810506613.0, entitled "Low Intermodulation Radiofrequency Coaxial Connector", filed on May 24, 2018, the content of which is expressly incorporated herein by reference in its entireties.

TECHNICAL FIELD

The disclosure relates to an overall solution of a low intermodulation radiofrequency coaxial connector with a low cost, a high efficiency, and a high reliability, which can effectively suppress the nonlinear effect caused by a radiofrequency interconnection and thereby ensuring the low intermodulation. In the overall solution, a low-cost elastic contact ring as a core interconnection component is integrated into an interconnection channel of a radiofrequency signal to form a new type of radiofrequency coaxial connector. In the implementation of this new type of radiofrequency coaxial connector, the low intermodulation contact ring involved in the present disclosure can be applied to the connection interface, middle end or tail end of the coaxial connector and all components that require the low intermodulation interconnection. At the same time, the low intermodulation contact ring is also suitable for the contact interconnection of an outer conductor or an inner conductor of the radiofrequency coaxial connector. The overall solution for the radiofrequency interconnection involved by the present disclosure is suitable for all radiofrequency interconnection occasions that need to solve the low intermodulation, and satisfies the application requirements of the low cost and low intermodulation of the connection interface or tail end interconnection of the radiofrequency coaxial connector.

BACKGROUND

When the radiofrequency coaxial connector is installed or inserted, the reliable connections between the socket and the installation panel, and between the plug and the socket are the most basic requirement for the connector. In the radiofrequency coaxial connector, an overlap of electrical interfaces of the plugs and socket is generally utilized to implement the electrical connection to ensure the radiofrequency transmission performance, such as the widely used SMA series, N series, 7/16 series and the newly developed QMA series, etc. The characteristics of such electrical connection manner is to apply and maintain a certain pressing force on a docking interface through threads (such as SMA series, N series, 7/16 series) or other locking mechanisms (such as QMA series) to make the docking interfaces of the plug and socket closely fitted to ensure the electrical transmission performance. Since the interfaces of the plug and the socket need to be tightly fitted, an axial docking position of a connector using such connection manner is fixed, which cannot meet the requirements of axial floating and compensation. For this reason, in order to satisfy the relatively flexible docking requirements to compensate for an axial mating tolerance, people have developed a coaxial connector with an elastic groove on the outer conductor to provide a side contact function, such as L16 series, BNC series, QNC series, SHV series and SMP series, etc., and a coaxial connector with an axial compensation ring, such as BMA series and QN series. Such coaxial connector with the side contact function or the axial compensation ring has a flexible connection interface, allowing the docking position of the plug and the socket to have a certain range of movement to compensate for the axial tolerance of the docking or locking mechanism. However, such product still has more or less defects in terms of cost, performance and reliability, especially in applications requiring higher intermodulation performance indicators, and it is difficult to meet the requirements due to the inherent defects thereof.

SUMMARY

In view of this, as for deficiencies in the prior art and for effectively reducing nonlinear intermodulation indicators of the radiofrequency coaxial connector, the present disclosure provides a radiofrequency coaxial connector overall solution with a low cost, a high efficiency and a highly reliability.

To address the above problems, the technical solution adopted by the present disclosure is provided as follows.

A low intermodulation radiofrequency coaxial connector includes a first outer conductor and a second outer conductor matching the first outer conductor; a contact ring is provided between the first outer conductor and the second outer conductor, and the first outer conductor is elastically in contact with the second outer conductor through the contact ring.

As an improvement to the above solution, the contact ring is compressed in a natural state.

As an improvement to the above solution, the first outer conductor is provided with a groove configured to limit and fix the contact ring.

As an improvement to the above solution, the contact ring is annular and has outer contact arc surfaces protruding outward.

As an improvement to the above solution, the outer contact arc surfaces are evenly distributed along a circumferential direction.

As an improvement to the above solution, one end of an inner side of the contact ring is provided with a positioning piece, and the positioning piece is mated and matched with the groove, and the groove limits an axial movement of the positioning piece.

As an improvement to the above solution, an inner contact point is provided on an inner side of the contact ring, and the inner contact point is directly in linear contact with the first outer conductor.

As an improvement to the above solution, the inner contact point is provided at a same end as the positioning piece adjacent to the inner side of the contact ring.

As an improvement to the above solution, one end of an inner side of the contact ring is provided with a positioning piece, and the other end is in a free state.

The present disclosure mainly provides a radiofrequency coaxial connector overall solution with a low cost, a high efficiency and a high reliability for effectively reducing the non-linear intermodulation indicators of the radiofrequency coaxial connector. In the specific method, an elastic strip is used and molded by a press die to form uniform and dense inner and outer contact points, and then joint the head portion and tail portion by spot welding or other methods to form a circular contact ring with dense and uniform contact points (or rectangular or other shaped contact rings). The contact ring with such dense and uniform contact points is assembled on the outer conductor (or inner conductor) of the radiofrequency coaxial connector through corresponding tooling to implement the low intermodulation interconnection when the plug and the socket of the radiofrequency coaxial connector are docked (interface interconnection) or the low intermodulation interconnection of the tail portion (termination interconnection) when the radiofrequency coaxial connector (plug or socket) is installed. The low intermodulation elastic contact ring involved in the present disclosure adopts a side contact structure, and is applied to various radiofrequency coaxial connectors, especially applied to the radiofrequency coaxial connectors with direct plugging and unplugging and quick locking and with requirements of higher intermodulation indicators.

During the installation or docking process of the plug and the socket of the radiofrequency coaxial connector, the low intermodulation elastic contact ring of the present disclosure will be radially compressed, and the outer surface thereof will contract inward under the action of the radial pressure, and a plurality of contact points evenly distributed on the circumference are formed between two outer conductors needing to be interconnected, to make the contact reliable. The uniform and reliable contact interconnection guaranteed by the low intermodulation elastic contact ring structure of the present disclosure makes the transmission current distributed uniformly, thereby effectively suppressing nonlinearity and meeting the requirements of low intermodulation performance.

Compared with the prior art, the implementation effects of the present disclosure are as follows.

The low intermodulation elastic contact ring and a positioning method thereof in the present disclosure have the following significant advantages.

(1) The low intermodulation contact ring and an overall solution for the radio frequency coaxial connector in the present disclosure can effectively suppress the nonlinear effect of a radiofrequency signal interconnection, and ensure critical performance indicators such as low intermodulation of radiofrequency interconnection, etc.

(2) The low intermodulation contact ring in the overall solution of the radiofrequency coaxial connector in the present disclosure is punched and molded from an elastic metal material and then joints the head portion and the tail portion thereof to form a contact ring. The structure is simple, the connection is reliable, the workmanship is good, the assembly is easy, and the cost is low.

DETAILED DESCRIPTION

The present disclosure will be described below in conjunction with specific embodiments.

Figure 1:
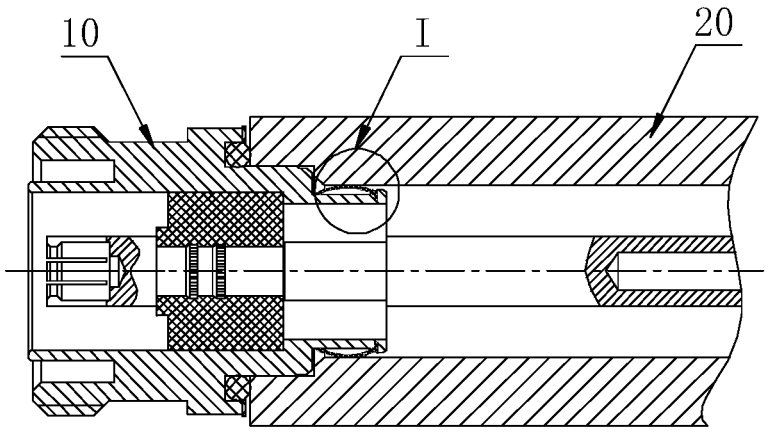
FIG. 1 is a schematic diagram illustrating a terminating structure of a radiofrequency coaxial connector according to the present disclosure.
Figure 2:
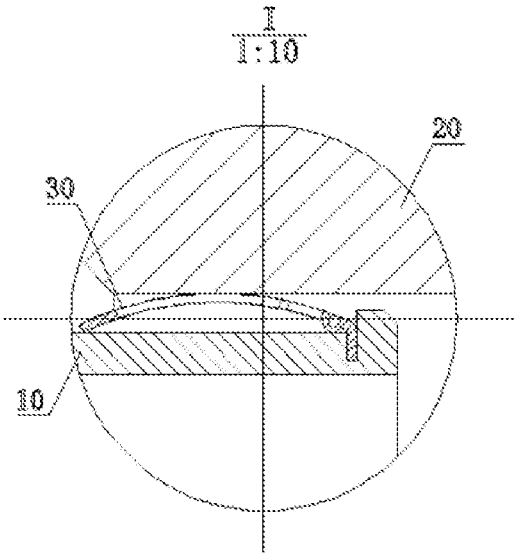
FIG. 2 is a partial enlarged view of a portion I in FIG. 1.

FIG. 1 is a schematic diagram illustrating a terminating structure of a radiofrequency coaxial connector according to a preferred embodiment of the overall solution of the radiofrequency coaxial connector involved in the present disclosure. Of course, the overall solution of the radiofrequency coaxial connector involved in the present disclosure is not limited to the application shown in FIG. 1, but can also be applied to interconnections at various positions such as the interpolation interface, the middle portion, etc., of the connector. FIG. 2 is a partial enlarged view of a portion I in FIG. 1. The radiofrequency coaxial connector of the present disclosure includes a first outer conductor 10 and a second outer conductor 20 matching the first outer conductor 10. A contact ring 30 is provided between the first outer conductor 10 and the second outer conductor 20. The contact ring 30 is elastic, and the first outer conductor 10 is elastically in contact with the second outer conductor 20 through the contact ring 30. A natural state of the contact ring 30 is a compressed state, so that a reliable elastic contact between the first outer conductor 10 and the second outer conductor 20 can always be maintained, accordingly the electrical performance is guaranteed, and the low intermodulation elastic contact is implemented.

Figure 3:
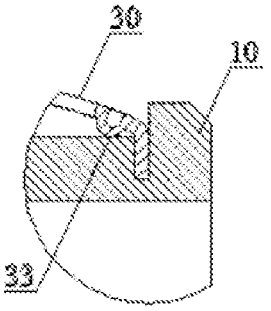
FIG. 3 is a schematic diagram illustrating a matching structure of a contact ring and a first outer conductor.
Figure 4:
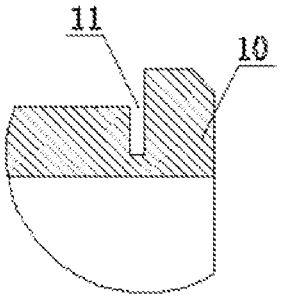
FIG. 4 is a schematic structure diagram of the first outer conductor in FIG. 3.
Figure 5:
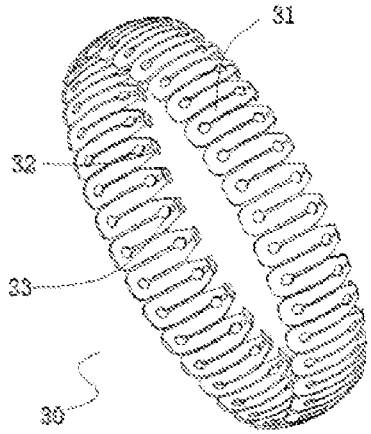
FIG. 5 is a schematic structure diagram of a contact ring according to the present disclosure.
Figure 6:
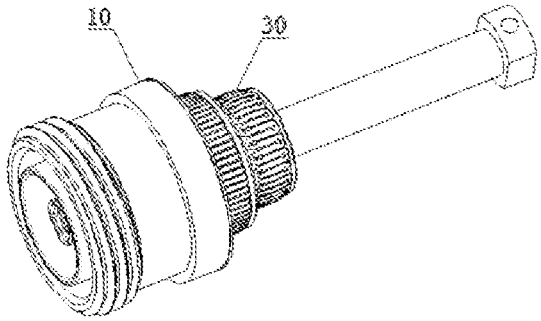
FIG. 6 is a schematic perspective structure diagram illustrating that a contact ring is mounted on a first outer conductor according to the present disclosure.

As shown in FIG. 3, it is a schematic diagram illustrating a matching structure of the contact ring 30 and the first outer conductor 10. FIG. 4 is a schematic structure diagram of the first outer conductor 10 in FIG. 3; FIG. 5 is a schematic structure diagram of the contact ring 30 according to the present disclosure; FIG. 6 is schematic perspective structure diagram illustrating that a contact ring is mounted on a first outer conductor 10 according to the present disclosure. The first outer conductor 10 of the present disclosure is provided with a groove 11, and the groove 11 is configured to limit and fix the contact ring 30. The contact ring 30 is annular and has outer contact arc surfaces 31 protruding outward. The outer contact arc surfaces 31 are evenly distributed along a circumferential direction, so that the force on the outer contact arc surface 31 is evenly distributed, and a stable electrical performance is obtained. On an end of an inner side of the contact ring 30 is further provided a positioning piece 32 which is mated and matched with the groove 11, and the groove 11 limits the axial movement of the positioning piece 32, thereby limiting the axial movement of the contact ring 30 on the first outer conductor 10. On an end of the inner side of the contact ring 30 adjacent to the positioning piece 32 is further provided an inner contact point 33, and the inner contact point 33 is directly in linear contact with the first outer conductor 10, accordingly a reliability of the contact and the electrical performance thereof are guaranteed, and the low intermodulation elasticity contact thereof is implemented.

In the contact ring 30 of the present disclosure, only on one end of the inner side is provided a positioning piece 32, and the other end is free. In such a way, when the contact ring 30 is elastically deformed, the positioning piece 32 is axially fixed and the other end is freely deformed, which is beneficial to the elastic deformation and ensures reliable contact and electrical performance.

In the contact ring 30 of the present disclosure, the presence of the inner contact point 33 converts a direct contact between the contact ring 30 and the first outer conductor 10 into a direct linear contact between the inner contact point 33 and the first outer conductor 10, thereby guaranteeing the reliability of contact, guaranteeing the electrical performance thereof, and implementing the low intermodulation elastic contact thereof.

In the contact ring 30 of the present disclosure, the positioning piece 32 and the inner contact point 33 are provided at the same end. Since the positioning piece 32 is fixed axially, which can fully guarantee the direct linear contact between the inner contact point 33 and the first outer conductor 10, and accordingly, the reliability of the contact and the electrical performance are guaranteed, and the low intermodulation elastic contact is implemented.

In the contact ring 30 of the present disclosure, the first outer conductor 10 is provided with a groove 11, and the positioning piece 32 on the contact ring 30 is matched with the groove 11. In fact, the second outer conductor 20 is provided with the same structure to limit the axial movement of the positioning piece 32, accordingly the same function can be implemented, the reliability of the contact is guaranteed, the electrical performance thereof can be guaranteed, and the low intermodulation elastic contact thereof can be implemented. However, this belongs to another embodiment, which also does not depart from the essence of protection scope of the present disclosure.

The above is a detailed description of the present disclosure in conjunction with specific embodiments. The present disclosure cannot be considered as being limited to these embodiments. Those skilled in the art to which the present disclosure belongs can make several simple deductions or replacements without departing from the concept of the present disclosure, which should be regarded as falling within the protection scope of the present disclosure.

What is claimed is:

1. A low intermodulation radiofrequency coaxial connector, comprising a first outer conductor and a second outer conductor matching the first outer conductor, wherein a contact ring is provided between the first outer conductor and the second outer conductor, and the first outer conductor is elastically in contact with the second outer conductor through the contact ring;

wherein an inner contact point is provided on an inner side of the contact ring, and the inner contact point is directly in linear contact with the first outer conductor;

wherein the inner contact point is provided at a same end as a positioning piece adjacent to the inner side of the contact ring.

2. The low intermodulation radiofrequency coaxial connector according to claim 1, wherein the contact ring is compressed between the first outer conductor and the second outer conductor.

3. The low intermodulation radiofrequency coaxial connector according to claim 1, wherein the first outer conductor is provided with a groove configured to limit and fix the contact ring.

4. The low intermodulation radiofrequency coaxial connector according to claim 3, wherein the contact ring is annular and has outer contact arc surfaces protruding outward.

5. The low intermodulation radiofrequency coaxial connector according to claim 4, wherein the outer contact arc surfaces are evenly distributed along a circumferential direction.

6. The low intermodulation radiofrequency coaxial connector according to claim 3, wherein one end of the inner side of the contact ring is provided with the positioning piece, and the positioning piece is mated and matched with the groove, and the groove limits an axial movement of the positioning piece.

7. The low intermodulation radiofrequency coaxial connector according to claim 1, wherein one end of the inner side of the contact ring is provided with the positioning piece, and the other end is in a free state.

8. The low intermodulation radiofrequency coaxial connector according to claim 4, wherein one end of the inner side of the contact ring is provided with the positioning piece, and the positioning piece is mated and matched with the groove, and the groove limits an axial movement of the positioning piece.

9. The low intermodulation radiofrequency coaxial connector according to claim 5, wherein one end of the inner side of the contact ring is provided with the positioning piece, and the positioning piece is mated and matched with the groove, and the groove limits an axial movement of the positioning piece.

* * * * *